US009554653B2

(12) United States Patent
Lee

(10) Patent No.: US 9,554,653 B2
(45) **Date of Patent: *Jan. 31, 2017**

(54) COMPACT, COLLAPSIBLE, CAMPING CHAIR WITH A UNITARY CENTRAL TUBE CONNECTOR

(71) Applicant: FIMAX International Co., Ltd, Seoul (KR)

(72) Inventor: Youn Jae Lee, Pleasanton, CA (US)

(73) Assignee: FIMAX International Co., Ltd (KR)

( * ) Notice: Subject to any disclaimer, the term of this patent is extended or adjusted under 35 U.S.C. 154(b) by 47 days.

This patent is subject to a terminal disclaimer.

(21) Appl. No.: 14/666,103

(22) Filed: Mar. 23, 2015

(65) Prior Publication Data

US 2015/0189994 A1 Jul. 9, 2015

Related U.S. Application Data

(63) Continuation-in-part of application No. 14/040,633, filed on Sep. 28, 2013, now Pat. No. 9,066,597, and a continuation-in-part of application No. 14/605,318, filed on Jan. 26, 2015.

(51) Int. Cl.

| | |
|---|---|
| ***A47C 4/30*** | (2006.01) |
| ***A47C 3/18*** | (2006.01) |
| ***A47C 4/42*** | (2006.01) |

(52) U.S. Cl.

CPC . *A47C 3/18* (2013.01); *A47C 4/30* (2013.01); *A47C 4/42* (2013.01); *Y10T 29/49826* (2015.01)

(58) Field of Classification Search

CPC ..... A47C 3/18; A47C 4/28; A47C 4/42; A47C 4/32; A47C 4/30; Y10T 29/49826

See application file for complete search history.

(56) References Cited

U.S. PATENT DOCUMENTS

| | | | | |
|---|---|---|---|---|
| 4,258,951 A | 3/1981 | Groom | 297/16 | |
| D459,902 S | 7/2002 | Fox | D6/365 | |
| D460,280 S | 7/2002 | Fox | D6/365 | |
| 6,575,532 B2 * | 6/2003 | Almerico | A47C 3/18 297/344.26 | |

(Continued)

FOREIGN PATENT DOCUMENTS

| | | |
|---|---|---|
| EP | 00139306 A1 | 9/1983 |
| JP | 7010582 Y2 | 5/1990 |

(Continued)

*Primary Examiner* — Philip Gabler

(74) *Attorney, Agent, or Firm* — Imperium Patent Works; Darien K. Wallace

(57) ABSTRACT

A compact collapsible camping chair includes upper tubes, leg tubes, a molded central tube connector and a seat back. The tube connector is molded from aluminum, zinc or plastic reinforced with glass fiber. Lower ends of the upper tubes fit snugly into circular upper holes in the central tube connector, and upper ends of the leg tubes fit snugly into circular lower holes in the central tube connector. Upper ends of the upper tubes fit into tube receptacles in the seat back. The two longer upper tubes are bent, whereas the two shorter upper tubes are straight. Elastic cords pass from the upper tubes, through the tube connector and into the leg tubes and tend to pull the tubes into the holes in central tube connector. The upper tubes, leg tubes, central tube connector and seat back can be placed in a bag that is less than one foot long.

20 Claims, 19 Drawing Sheets

(56) References Cited

U.S. PATENT DOCUMENTS

| | | | | |
|---|---|---|---|---|
| 7,210,179 | B2 * | 5/2007 | Kidwell | A47C 1/14 5/632 |
| 8,042,865 | B2 | 10/2011 | Fargason, III | 297/184.15 |
| 8,272,684 | B2 | 9/2012 | Obolewicz et al. | 297/16.2 |
| 8,322,784 | B2 | 12/2012 | Ayre et al. | 297/45 |
| 2002/0117878 | A1 | 8/2002 | Fox | 297/16.2 |
| 2012/0104805 | A1 * | 5/2012 | Lah | A47C 9/105 297/16.1 |
| 2012/0326470 | A1 | 12/2012 | Homans et al. | 297/16.1 |
| 2013/0049410 | A1 | 2/2013 | Stafford et al. | 297/16.1 |

FOREIGN PATENT DOCUMENTS

| | | |
|---|---|---|
| KR | 1020110077110 | 12/2009 |
| KR | 1020120044577 | 10/2010 |

* cited by examiner

COMPACT, COLLAPSIBLE, CAMPING CHAIR WITH A UNITARY CENTRAL TUBE CONNECTOR

CROSS REFERENCE TO RELATED APPLICATION

This application is a continuation-in-part of, and claims priority under 35 U.S.C. §120 from, nonprovisional U.S. patent application Ser. No. 14/040,633 entitled "A Compact, Collapsible, Swivel Camping Chair," filed on Sep. 28, 2013, the subject matter of which is incorporated herein by reference. In addition, this application is a continuation-in-part of, and claims priority under 35 U.S.C. §120 from, nonprovisional U.S. patent application Ser. No. 14/605,318 entitled "A Sturdy, Compact, Collapsible Camping Chair with a Central Tube Connector," filed on Jan. 26, 2015, the subject matter of which is incorporated herein by reference.

TECHNICAL FIELD

The described embodiments relate to chairs, and more particularly to collapsible, portable chairs that are suitable for camping, fishing, outdoor concerts and sporting events.

BACKGROUND

Portable chairs are convenient during outdoor activities at which seating is otherwise unavailable. Folding chairs that are commonly used in the home to save space are not considered sufficiently portable for most outdoor activities, such as camping, hiking, fishing, outdoor concerts and sporting events. A portable chair for outdoor activities should be light weight and compact. For example, a chair used for hiking or camping should advantageously fit into a back pack and not weigh down the hiker.

The typical tube-and-canvas folding chairs used at field-side sporting events are simply too large and heavy to take along on a hike. A smaller and lighter folding chair would also be more convenient even at events on a field that is a short distance from the trunk of the user's car.

FIG. 1 (prior art) shows an assembled, light-weight, collapsible chair 10 that is appropriate for hiking and camping. Chair 10 is assembled around two molded-plastic tube connectors 11. Metal tubes 12 are inserted into openings in the tube connectors 11 in order to assemble chair 10. The other ends of the tubes 12 are then inserted into corner pockets of a canvas seat back 13.

FIG. 2 (prior art) shows collapsible chair 10 of FIG. 1 in a disassembled state. The tubes 12 are removed from the tube connectors 11 and can be folded into the canvas seat back 13. Thus, collapsible chair 10 can be conveniently packed into a small bag or back pack. However, collapsible chair 10 has the disadvantage of being unstable, particularly on the uneven ground typically present at outdoor activities, such as camping, hiking, fishing, sporting events and concerts. Although the right two legs are spaced relatively far apart from the left two legs, the occupant of chair 10 still has a tendency to fall backwards because the front legs are spaced relatively close to the back legs. A solid metal frame of the same dimensions as chair 10 might provide more stability, but the light-weight metal tubes 12 tend to bend somewhat under the weight of the occupant and permit the center of gravity to shift behind the ends of the back legs.

A compact, light-weight collapsible chair is sought that is nevertheless sturdy and stable and suitable for use on uneven ground.

SUMMARY

A compact, light-weight collapsible chair includes upper tubes, leg tubes, a central tube connector and a fabric seat back. The upper tubes are divided into detachable sections. Lower ends of the upper tubes are detachably connected by being inserted into upper holes in the central tube connector. Upper ends of the leg tubes are detachably connected by being inserted into lower holes in the central tube connector. Upper seat ends of the upper tubes are detachably connected to tube receptacles in the seat back. No part of the upper tubes other than the lower ends and the seat ends contacts any part of the collapsible chair. The upper holes are disposed in an upper portion of the central tube connector, and the lower holes are disposed in a lower portion. The upper portion swivels over the lower portion. The upper portion and the attached upper tubes swivel about a cylinder that passes through the upper and lower portions but does not extend above or below the central tube connector.

There are two upper tubes with a first length and two upper tubes with a shorter second length. The lower ends of the upper tubes are dimensioned to fit snugly into holes in the central tube connector. In one embodiment, the central tube connector is a means for detachably connecting the upper tubes to an upper portion that swivels over a lower portion to which the leg tubes are detachably connected. No part of the upper tubes other than the lower ends contacts the means.

An elastic cord passes through each of the tubes and pulls the tubes towards the central tube connector. For example, an elastic cord that passes from one tube, into a hole in the central tube connect, out through another hole in the central tube connector and into another one of the tubes. In one embodiment, the central tube connector is spherical.

A method of manufacturing a collapsible chair includes forming tubes, a central tube connector and a seat back and then placing the tubes, connector and seat back in a bag that is less than one foot long. A plurality of upper tubes are formed in detachable sections. The upper tubes have lower ends and seat ends. A plurality of leg tubes are formed with upper ends and ground ends. A plurality of upper holes and a plurality of lower holes are formed in the central tube connector. The lower ends of the upper tubes are dimensioned to fit snugly into the upper holes, and the upper ends of the leg tubes are dimensioned to fit snugly into the lower holes. An elastic cord is pulled through each of the tubes, into one of the holes, out another of the holes and into another tube. The seat back has a plurality of tube receptacles disposed at locations on the seat back so as to fit over the seat ends of the upper tubes.

In another embodiment, a collapsible camping chair includes a plurality of upper tubes, a plurality of leg tubes, a fabric seat back and a central tube connector molded from reinforced plastic. A plurality of upper holes and a plurality of lower holes with circular circumferences are formed in the molded central tube connector. The upper tubes have lower ends with circular cross sections and seat ends. The lower ends of the upper tubes are detachably connected to the central tube connector by being inserted into the upper holes such that there is no space between the lower ends of the upper tubes and the circumferences of the upper holes when the lower ends of the upper tubes are inserted into the upper holes. The upper ends of the leg tubes are detachably connected to the central tube connector by being inserted into the lower holes. The seat back has a plurality of tube receptacles. The seat ends of the upper tubes are detachably connected to the tube receptacles.

The central tube connector is molded from polyethylene or polyamide plastic reinforced with fiber glass and contains no metal. In yet another embodiment, the molded central tube connector is die-cast from aluminum or zinc. The central tube connector is molded with upper holes and lower holes that have circular circumferences and are disposed at the ends of cylindrical portions of the central tube connector. The circular cross sections of the lower ends of the upper tubes are dimensioned to fit snugly into the circular circumferences of the upper holes, and the upper ends of the leg tubes are dimensioned to fit snugly into the lower holes. The upper tubes consist of two tubes of a first length and two tubes of a second length that is shorter than the first length. Each of the two tubes of the first length is bent, and neither of the two tubes of the second length is bent. The upper tubes are made in detachable sections allowing the upper tubes, the leg tubes, the central tube connector and the seat back to be placed in a bag that is less than one foot long.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 3:
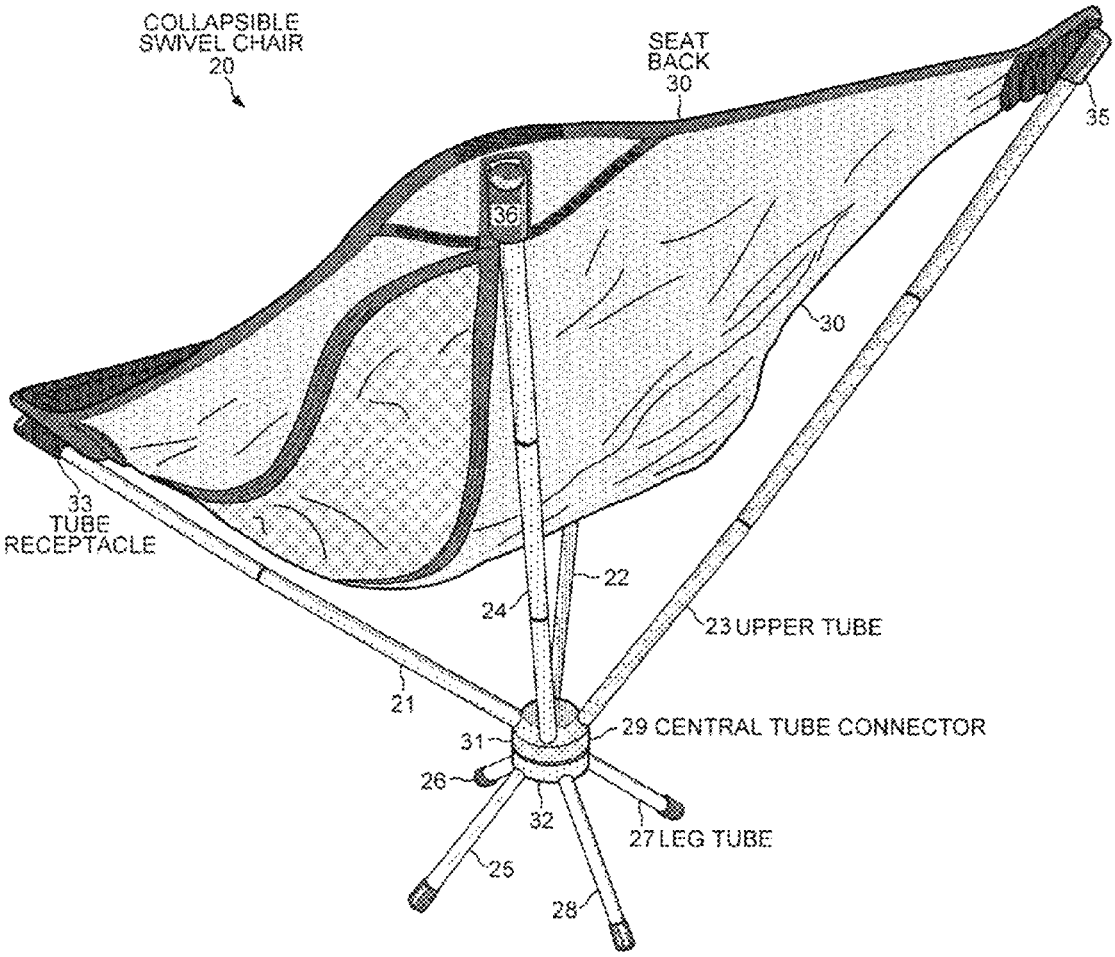
FIG. 3 is a perspective view of an assembled collapsible swivel chair according to the present invention.

FIG. 3 shows a compact, collapsible swivel chair 20 in an assembled state. Collapsible chair 20 can easily be disassembled and placed in a small bag that is about a foot long. Collapsible chair 20 consists of four upper tubes 21-24, four leg tubes 25-28, a central tube connector 29 and a seat back 30. The upper tubes 21-24 and leg tubes 25-28 are hollow tubes. Upper tubes 21-22 have detachable upper and lower sections, and upper tubes 23-24 have detachable upper, middle and lower sections. Central tube connector 29 has an upper portion 31 that swivels over a lower portion 32. The upper tubes 21-24, leg tubes 25-28 and central tube connector 29 are all made of aluminum, which is light weight yet strong. Thus, the light-weight, compact, collapsible chair 20, which fits into a small bag, is suitable especially for hiking and camping.

The upper tubes 21-24 have lower ends and seat ends. The lower ends of upper tubes 21-24 are detachably connected to central tube connector 29 by being inserted into four upper holes in upper portion 31. The upper ends of leg tubes 25-28 are detachably connected to the central tube connector by being inserted into four lower holes in lower portion 32. The seat ends of upper tubes 21-24 are detachably connected to tube receptacles 33-36, respectively, at the four corners of seat back 30. The tube receptacles 33-36 are hard plastic cylinders into which the seat ends of upper tubes 21-24 slide. The tube receptacles 33-36 are either glued or stitched to the fabric of seat back 30. In the assembled state of collapsible chair 20, no part of upper tubes 21-24 other than the lower ends and the seat ends contacts any part of the collapsible chair. The bottom ends of leg tubes 25-28 rest on the ground.

Figure 4:
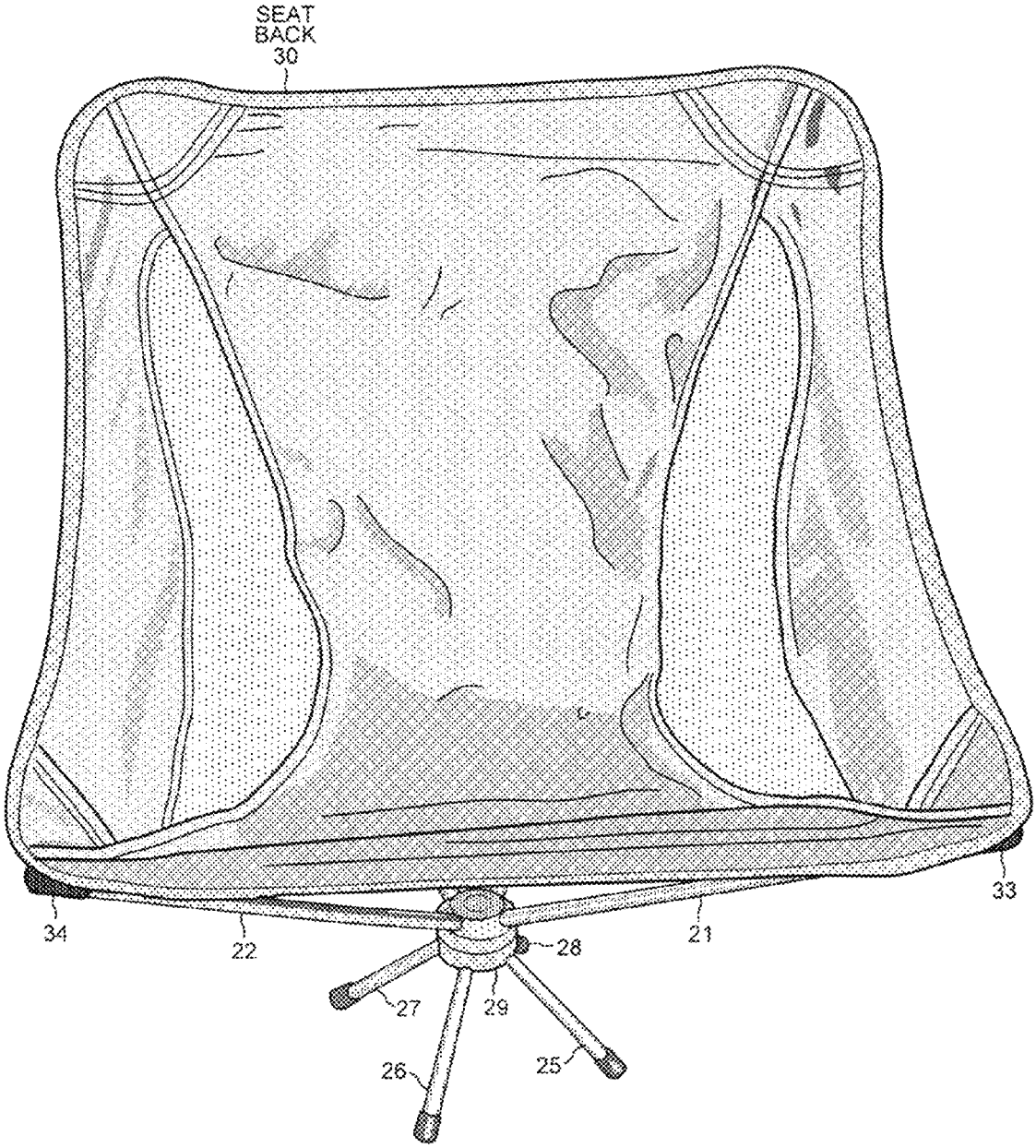
FIG. 4 is a perspective view of the front of the collapsible chair of FIG. 3.

FIG. 4 is a perspective view of collapsible chair 20 from the front. FIG. 4 shows that seat back 30 is stretched so that the tube receptacles 33-36 will fit over the seat ends of upper tubes 21-24. Thus, in the assembled state, upper tubes 21-24 are under some tension pulling their seat ends together. Seat back 30 is made of stitched pieces of woven fabric, such as canvas.

Figure 5:
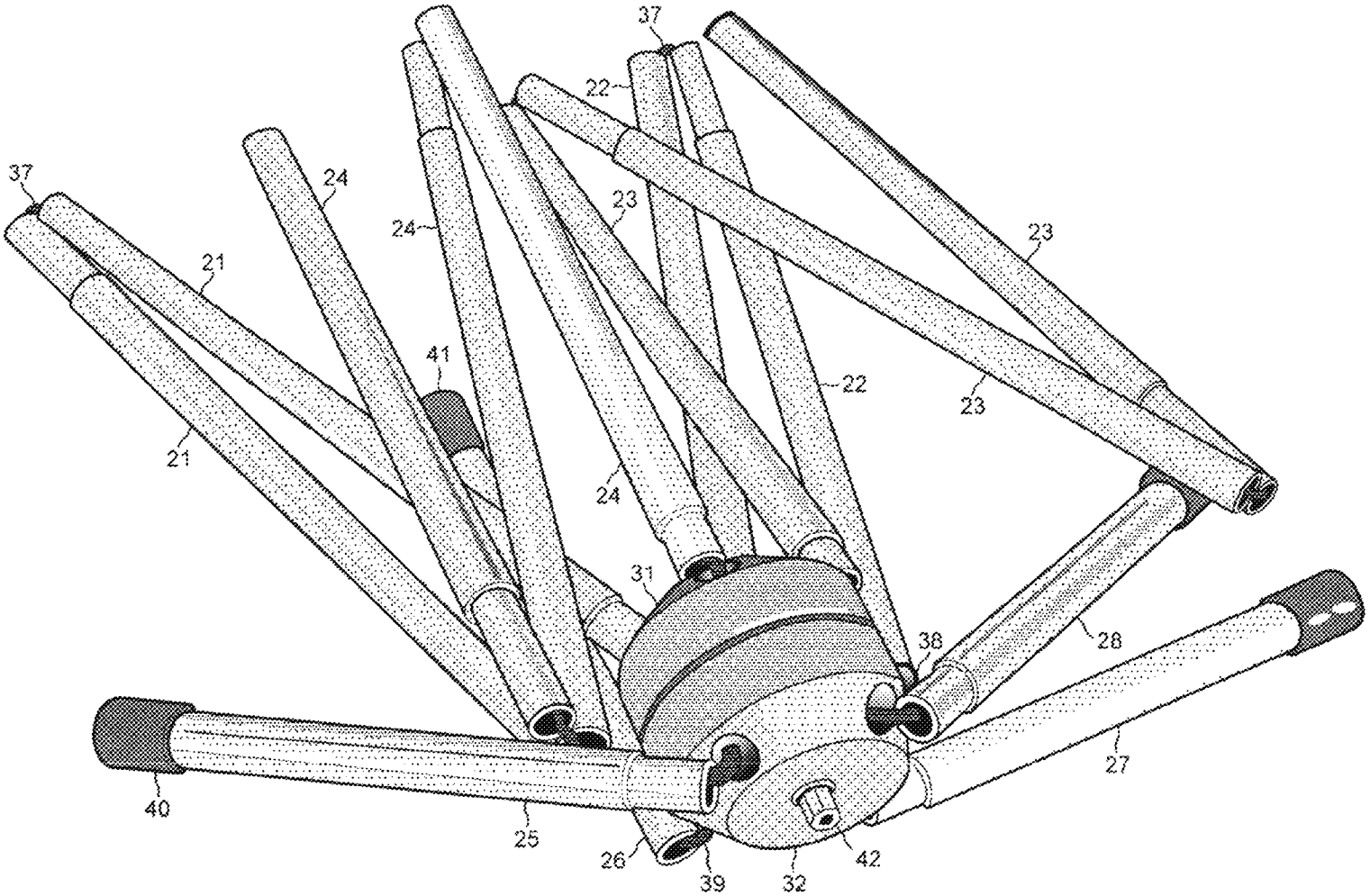
FIG. 5 shows the upper tubes, leg tubes and central tube connector of the collapsible chair of FIG. 3 in the collapsed state.

FIG. 5 shows upper tubes 21-24, leg tubes 25-28 and central tube connector 29 in the collapsed state. All of the tubes 21-28 have been pulled out of the holes in central tube connector 29. In addition, the sections of upper tubes 21-24 have been pulled apart. Elastic cords pass through all of the tubes and into the holes in central tube connector 29. The elastic cords tend to pull the tube sections into one another and the tubes into the holes in central tube connector 29. The ends of the elastic cords are attached to the inside of end plugs that fit into the seat ends of upper tubes 21-24 or into the bottom ends of leg tubes 25-28. One elastic cord passes from the end of one tube, through the holes in central tube connector 29 and out to the end of another tube. Thus, there are four elastic bands. For example, one end of an elastic cord 37 is attached to the inside of an end plug 38 that fits into the seat end of upper tube 22, and the other end of elastic cord 37 is attached to the inside of an end plug that fits into the seat end of upper tube 21. Elastic cord passes from tube 22 through one of the upper holes in upper portion 31, out another of the upper holes in upper portion 31 and into tube 21. Similarly, one end of a shorter elastic cord 39 is attached to the inside of a ground plug 40 at the bottom end of leg tube 25, while the other end of elastic cord 39 is attached to a ground plug 41 at the bottom end of leg tube 26. The shorter elastic cord 39 passes through two holes in lower portion 32. FIG. 5 also shows a bolt 42 with an Allen head that is used to pivotally attach power portion 32 to upper portion 31. Bolt 42 screws into a cylinder that passes through the centers of upper and lower portions 31-32.

Figure 6:
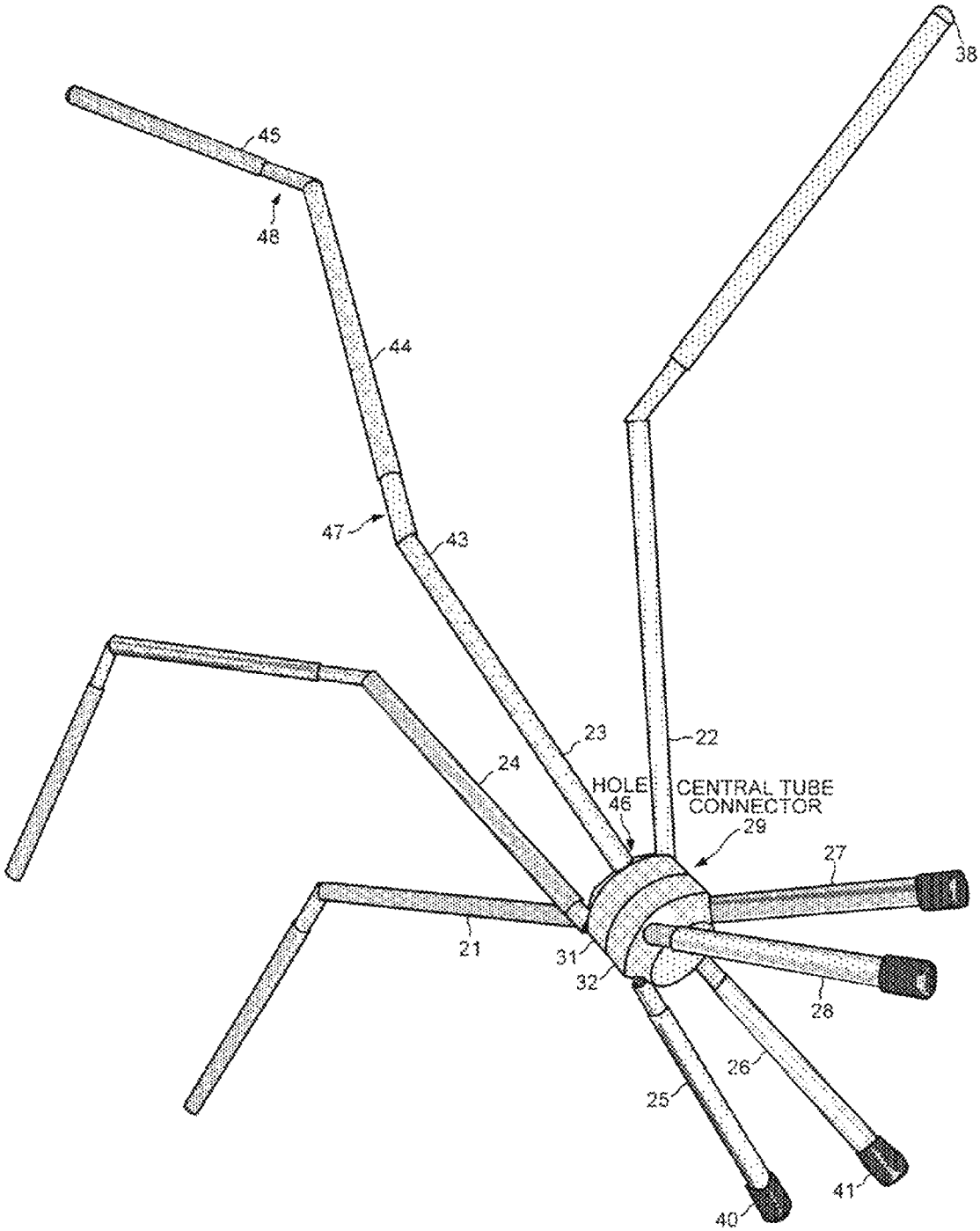
FIG. 6 shows the collapsible chair of FIG. 3 in the process of being assembled.

FIG. 6 shows collapsible chair 20 being assembled. When tubes 21-28 and central tube connector 29 are removed from their bag, the elastic cords tend to pull the detachable tube sections straight and tend to pull the tubes into the holes in central tube connector 29. The user can then align the tube sections with each other and with the holes, and the tubes are pulled into central tube connector 29. Each of longer upper tubes 23-24 has a lower, middle and upper section. For example, upper tube 23 has a lower section 43, a middle section 44 and an upper section 45, as labeled in FIG. 6. The lower inch of lower section 43 has a smaller outer diameter than the remainder of lower section 43. The lower portion with the smaller outer diameter fits snugly into an upper hole 46 in upper portion 31 of central tube connector 29. The lower portion 47 of middle section 44 and the lower portion 48 of upper section 45 have smaller outer diameters than the remainder of sections 44-45. Each of lower portions 47-48 is about two inches long. The lower portion 47 of section 44 with the smaller outer diameter fits into the top of section 43, and the lower portion 48 of section 45 with the smaller outer diameter fits into the top of section 44. Upper tubes 23-24 with three sections have a first length that is longer than the second length of upper tubes 21-22, which have only two sections. The longer upper tubes 23-24 support the back of seat back 30, whereas the shorter upper tubes 21-22 support the seat of seat back 30 upon which the user's legs rest.

Figure 7:
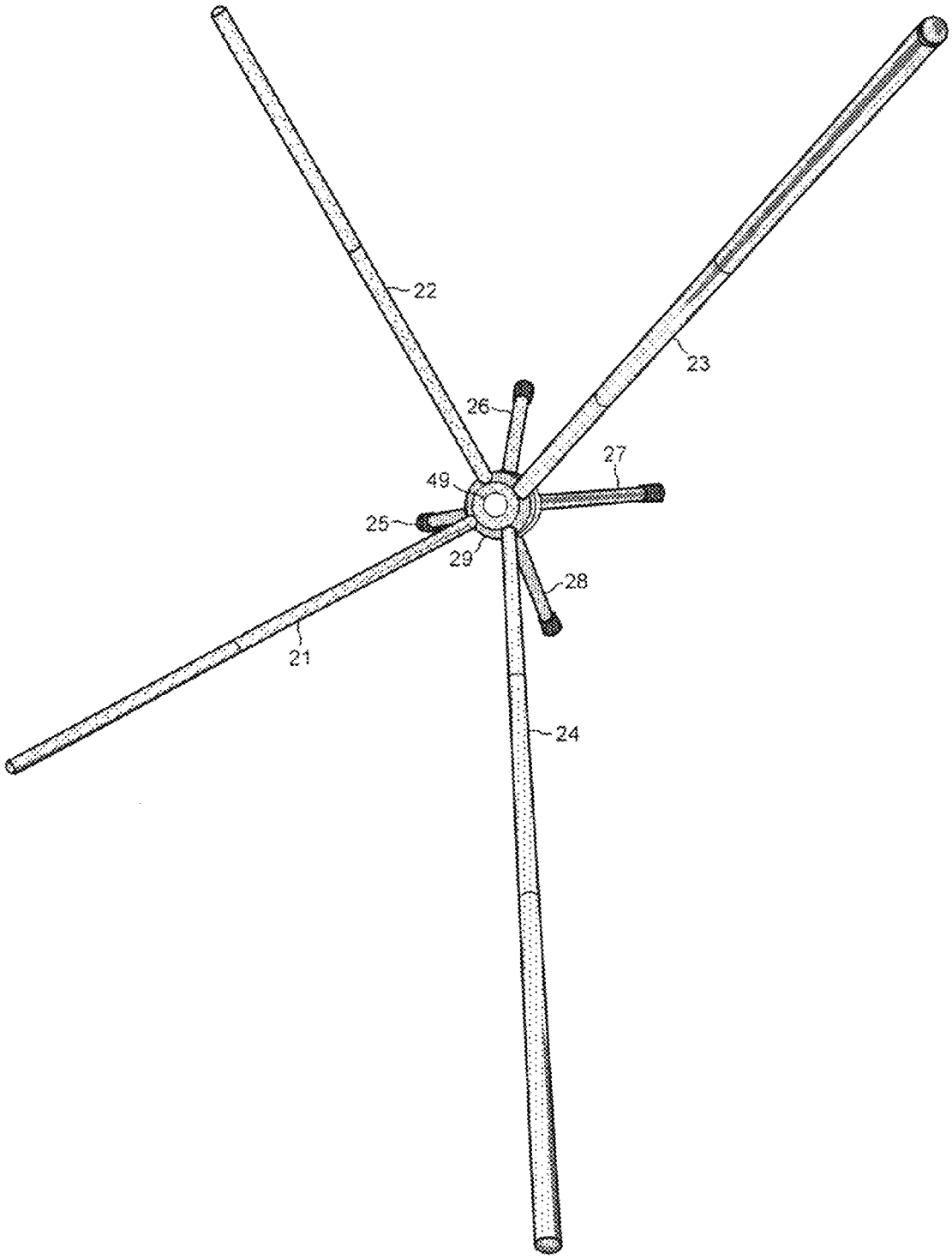
FIG. 7 is a perspective view of the collapsible chair of FIG. 3 from above before the seat back has been placed over the upper tubes.

FIG. 7 is a perspective view of collapsible chair 20 from above before the tube receptacles at the corners of seat back 30 have been slipped over the seat ends of upper tubes 21-24. FIG. 7 shows that upper tubes 23-24 are longer than upper tubes 21-22. From the top perspective of FIG. 7, the cylinder 49 is visible that passes through the centers of upper and lower portions 31-32. Upper portion 31 pivotally rotates over lower portion 32 about an axis that passes coaxially through cylinder 49. Bolt 42 tightens the two ends of cylinder 49 around upper and lower portions 31-32 holding them together. Upper tubes 21-24 and upper portion 31 swivel about short cylinder 49, which does not extend beyond the top or bottom of central tube connector 29.

Figure 1:
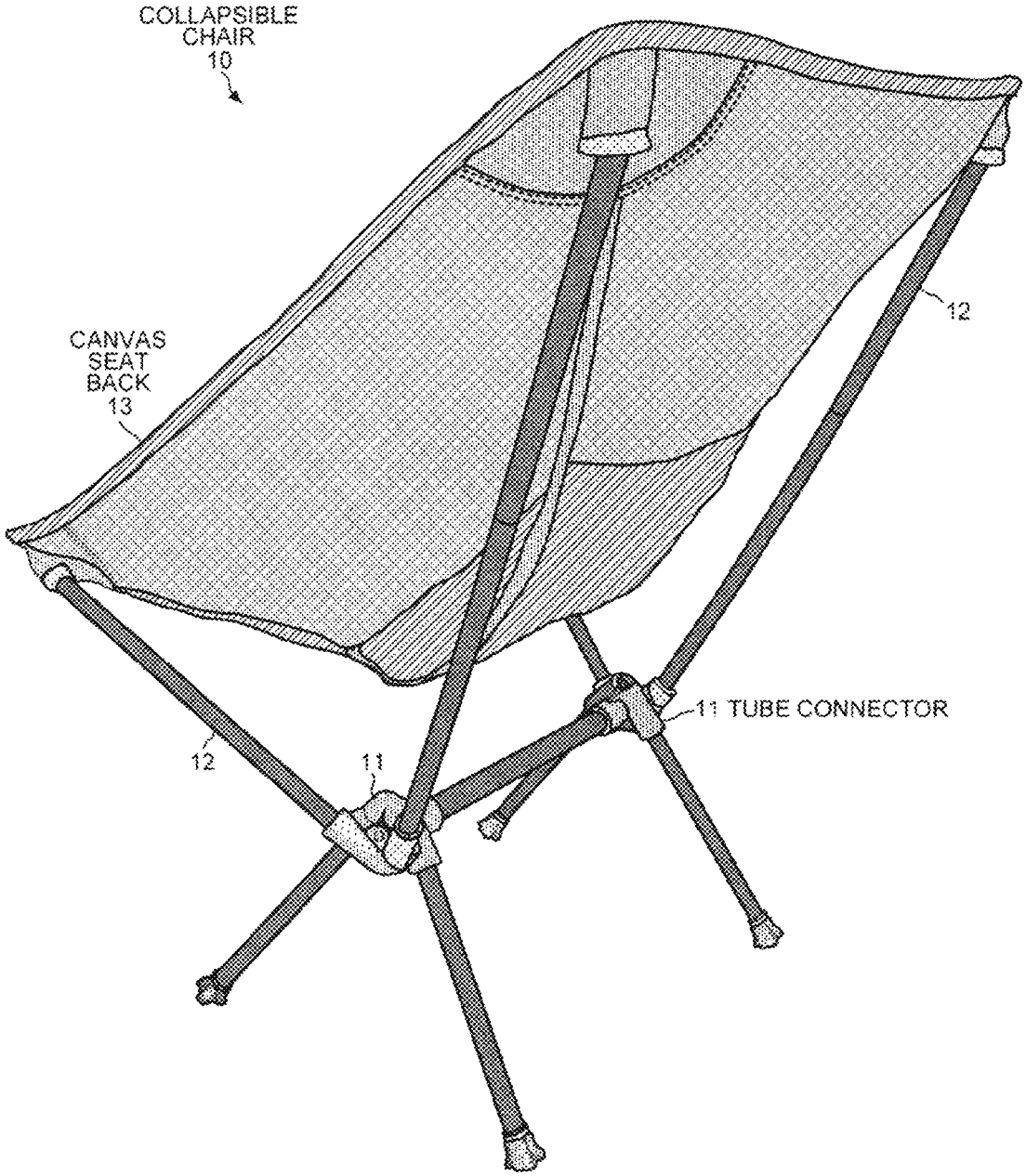
(PRIOR ART) FIG. 1
FIG. 1 (prior art) is a perspective view of a collapsible chair assembled around two spaced-apart tube connectors.
Figure 2:
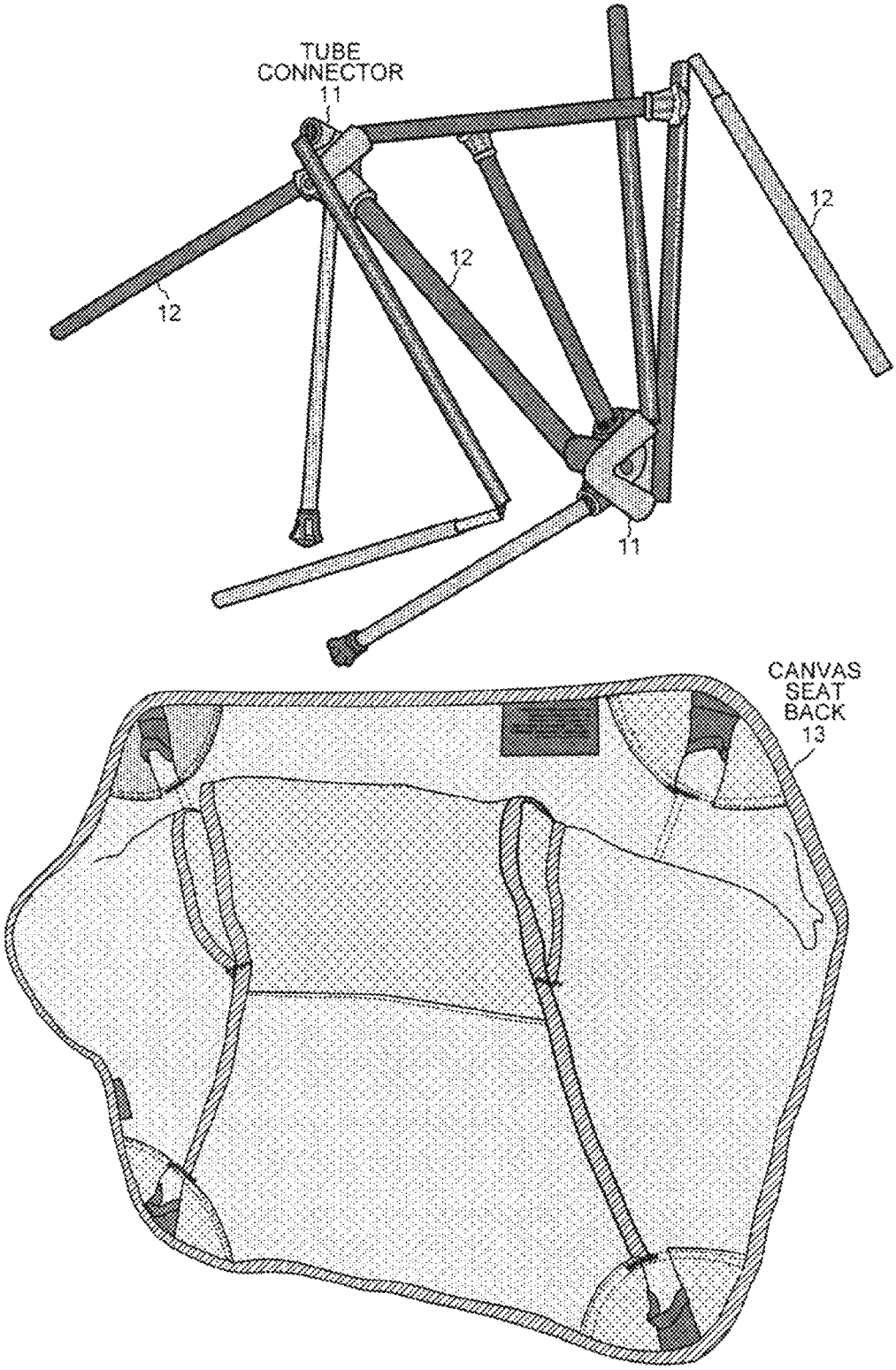
(PRIOR ART) FIG. 2
FIG. 2 (prior art) shows the components of the collapsible chair of FIG. 1 before they are assembled.
Figure 8:
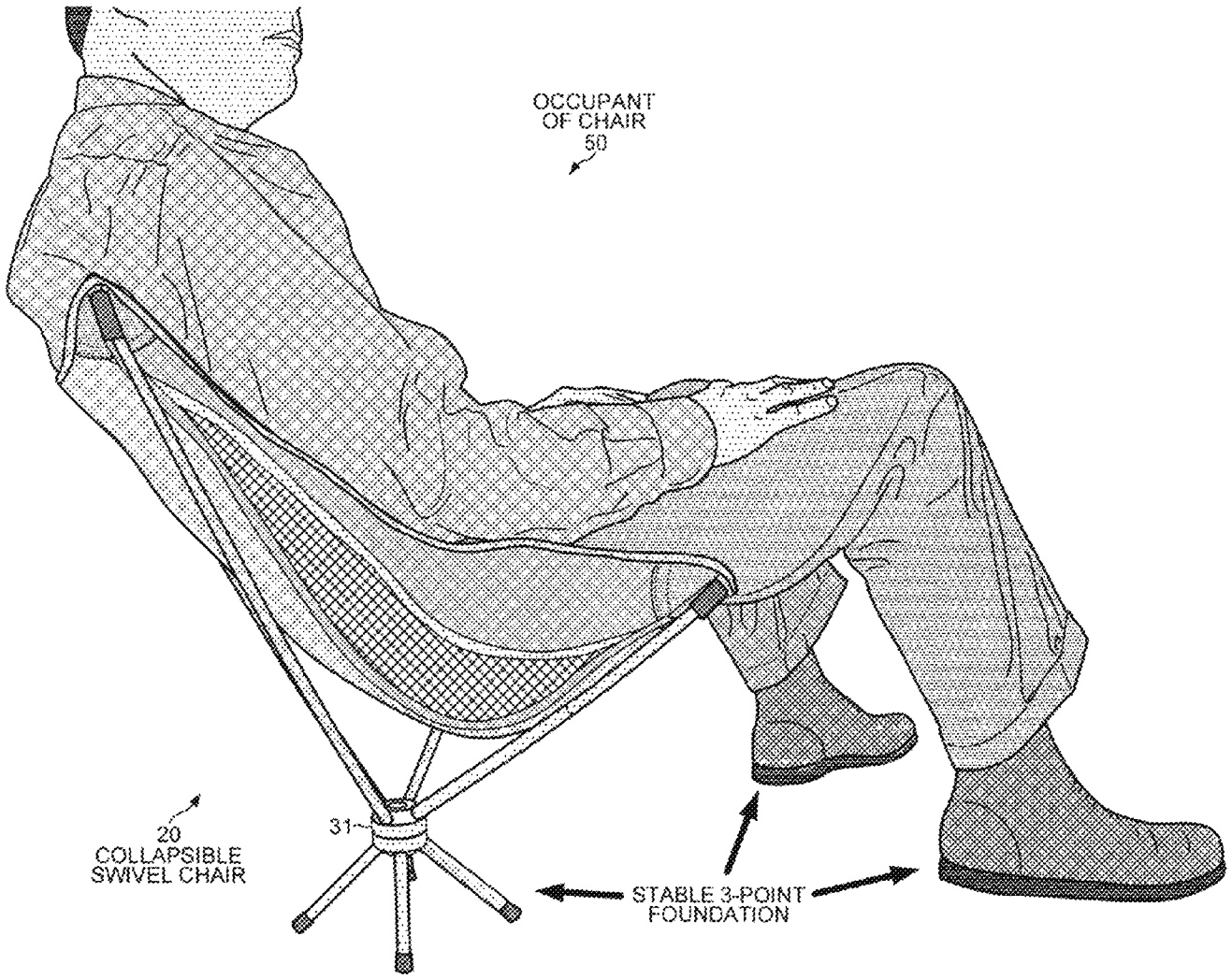
FIG. 8 shows an occupant sitting in the assembled collapsible chair of FIG. 3.

FIG. 8 shows an occupant 50 sitting in an assembled collapsible chair 20. FIG. 8 illustrates why swivel chair 20 is more stable than collapsible chair 10 of FIG. 1 that has the two spaced-apart tube connectors 11. Upper portion 31 of collapsible chair 20 can swivel to align the seat and upper tubes 21-24 with the occupant's feet, which are resting on the ground. Central tube connector 29 and the two feet of occupant 50 form a stable three-point foundation. The leg tubes 25-28 have a close spacing on the ground and act as a single support in the three-point foundation with the occupant's legs and feet. With the prior art chair 10, however, the seat is not able to swivel to align itself with the occupant's feet. Therefore, the occupant's feet support less of the occupant's weight, which inevitably becomes unevenly distributed over the four chair legs. The strength of a single tube leg attached to plastic tube connector 11 is often insufficient to support most of the occupant's weight, and the tube leg warps to a flat angle that the plastic tube connector 11 can no longer maintain. On the other hand, with collapsible chair 20 all of the occupant's weight that is distributed over central tube connector 29 is evenly distributed over all of the leg tubes attached to lower portion 32 of central tube connector 29. The swivel functionality of central tube connector 29 operates with the assistance of the occupant's feet. Collapsible chair 20 is not intended to swivel (to spin) an occupant whose feet are raised off the ground.

Figure 9:
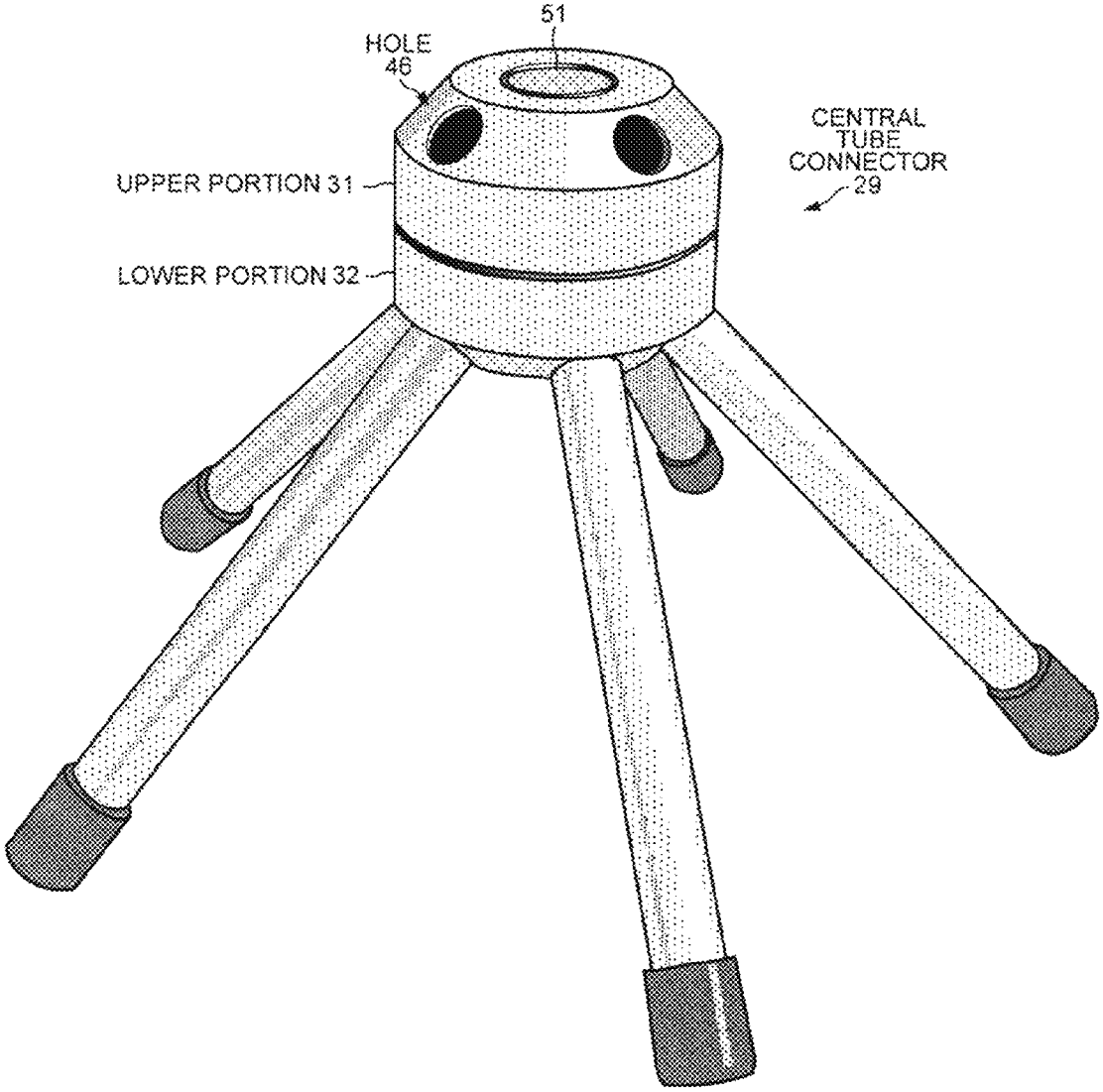
FIG. 9 shows the central tube connector of an embodiment of a collapsible chair that has five leg tubes.

FIG. 9 shows central tube connector 29 of an embodiment of collapsible chair 20 that has five leg tubes. The five leg tubes provide even more strength and stability than four leg tubes. FIG. 9 shows two of the four upper holes in upper portion 31 before upper tubes are inserted into the holes. The lower ends of the upper tubes are dimensioned to fit snugly into the holes. For example, FIG. 9 shows upper hole 46 into which detachable lower section 43 of upper tube 23 fits. FIG. 9 also shows the top disk 51 of cylinder 49.

Figure 10:
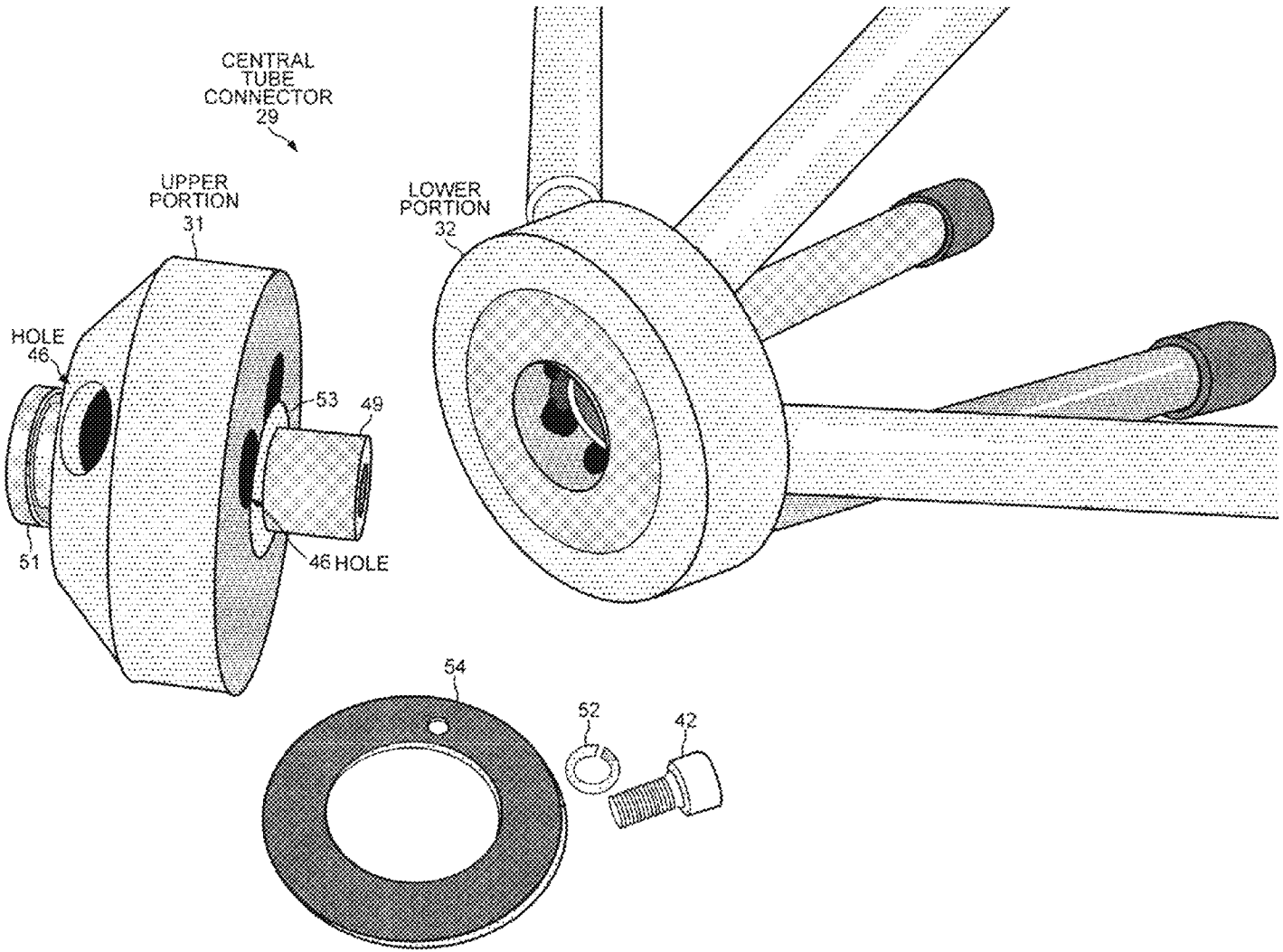
FIG. 10 shows the inside of the central tube connector of FIG. 9.

FIG. 10 shows central tube connector 29 in more detail. In FIG. 10, upper portion 31 has been separated from lower portion 32 exposing the inside of tube connector 29. Upper and lower portions 31-32 are made of solid cylindrical pieces of aluminum into which holes have been bored. A central coaxial hole is drilled completely through upper portion 31 and accommodates cylinder 49. Another central coaxial hole is drilled partially through lower portion 32 and accommodates the bottom of cylinder 49. A smaller diameter hole is made at the bottom of the partial central hole. Bolt 42 screws through the smaller diameter hole and into the bottom of cylinder 49 from the outside of lower portion 32 and pulls cylinder 49 down tight against the lower lip of top disk 51, which rests in a groove at the top of upper portion 31. A lock washer 52 prevents bolt 42 from coming loose. Upper portion 31 rotates about the axis of cylinder 49 over lower portion 32 by sliding over an inner washer 53 and an outer washer 54. Inner washer 53 fits inside outer washer 54.

FIG. 10 also shows that only two tube holes pass through the bottom surface of upper portion 31, even though there are four upper tubes 21-24. Upper tubes 23-24 that support the back of seat back 30 are detachably attached to upper portion 31 at a more vertical angle than are the upper tubes 21-22 that support the seat of seat back 30. Thus, the holes for tubes 23-24 exit through the bottom surface of upper portion 31, whereas the holes for tubes 21-22 exit into the central coaxial hole in upper portion 31. For example, FIG. 10 shows that hole 46 for tube 23 passes through the bottom surface of upper portion 31. A small groove is made between the holes that exit through the bottom surface in order to allow the elastic cord to pass through both holes without protruding over the bottom surface of upper portion 31. FIG. 10 also shows that the holes for the five leg tubes all exit into the partial central hole in lower portion 32 because the leg tubes are attached at a flatter angle to lower portion 32.

Figure 11:
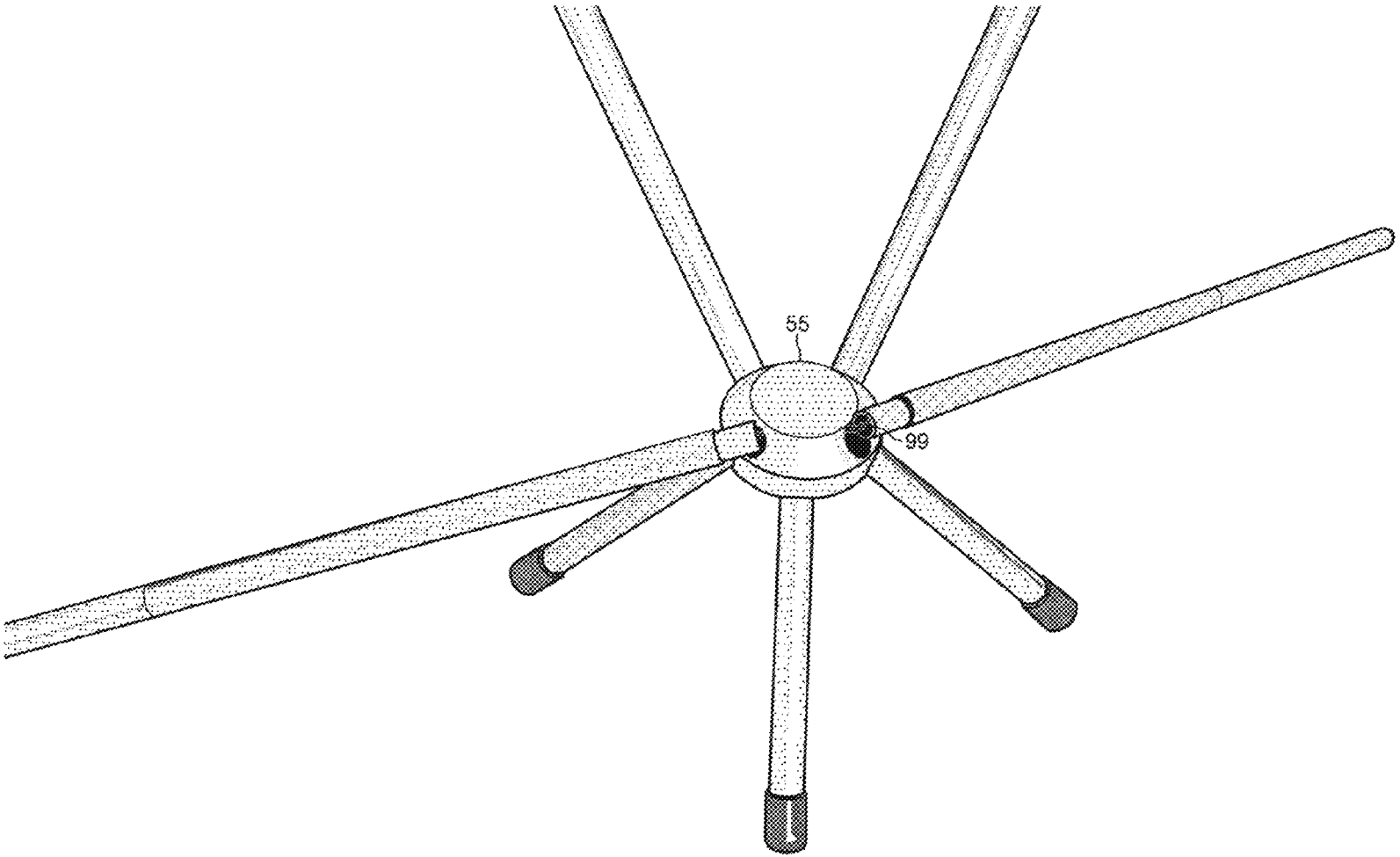
FIG. 11 is a perspective view of an embodiment of a collapsible chair in which the central tube connector is a single unit and does not swivel.

FIG. 11 is a perspective view of an embodiment of collapsible chair 20 in which central tube connector 29 is a single unit and does not swivel. The upper holes for the upper tubes as well as the lower holes for the leg tubes are all drilled into a single piece of aluminum 55. A central hole is bored into the single piece of aluminum 55 from the bottom. The holes for the tubes exit into the central hole. The elastic cords that pass from one upper tube to another upper tube and from one leg tube to another leg tube are routed through the central hole.

Figure 12:
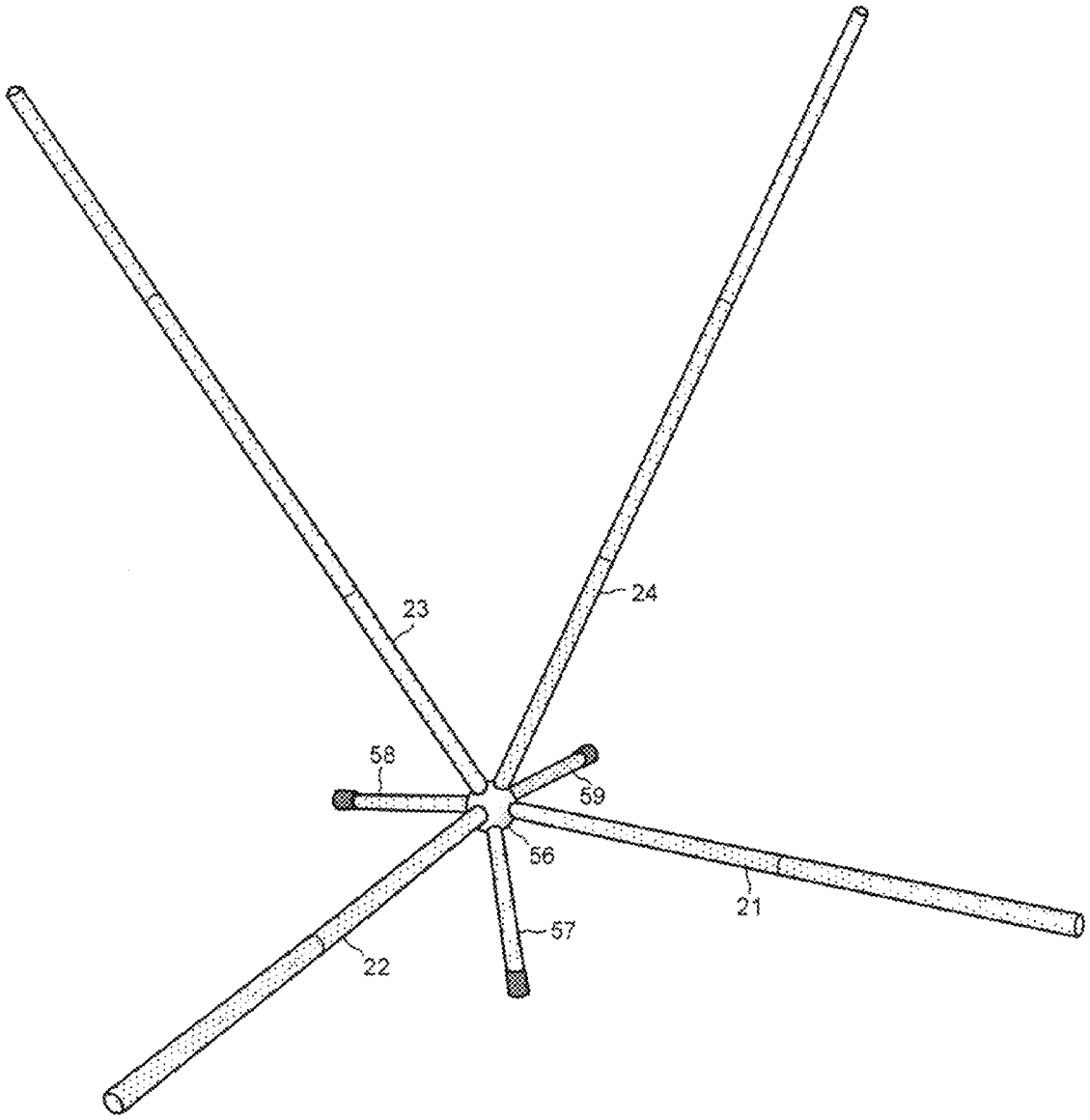
FIG. 12 is a perspective view of another embodiment of a collapsible chair in which the central tube connector is shaped as a sphere.

FIG. 12 is a perspective view of another embodiment of collapsible chair 20 in which central tube connector 29 is shaped as a sphere 56. Collapsible chair 20 of FIG. 12 has only three leg tubes 57-59.

Figure 13:
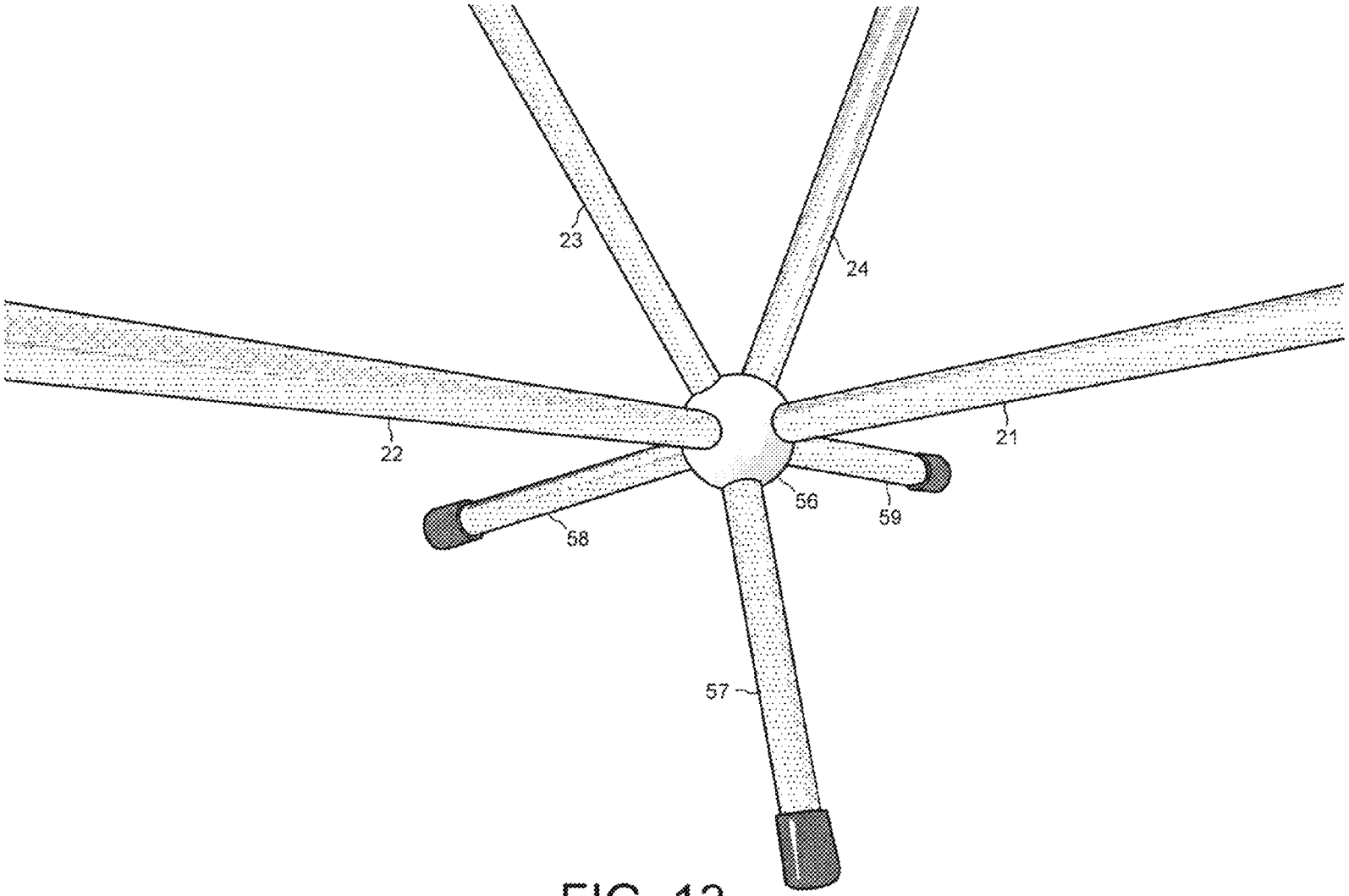
FIG. 13 shows the spherical central tube connector of FIG. 12 in more detail.

FIG. 13 is a more detailed view of sphere 56 of FIG. 12. The upper holes for the upper tubes 21-24 as well as the lower holes for the leg tubes 57-59 are all drilled into the aluminum sphere 56. No central hole is required through aluminum sphere 56 as all of the tube holes meet at the center of the sphere. The elastic cords can pass directly from one tube hole into another tube hole. The elastic cord for leg tube 59 is tied to the middle of the cord that passes between leg tube 57 and leg tube 58.

Figure 14:
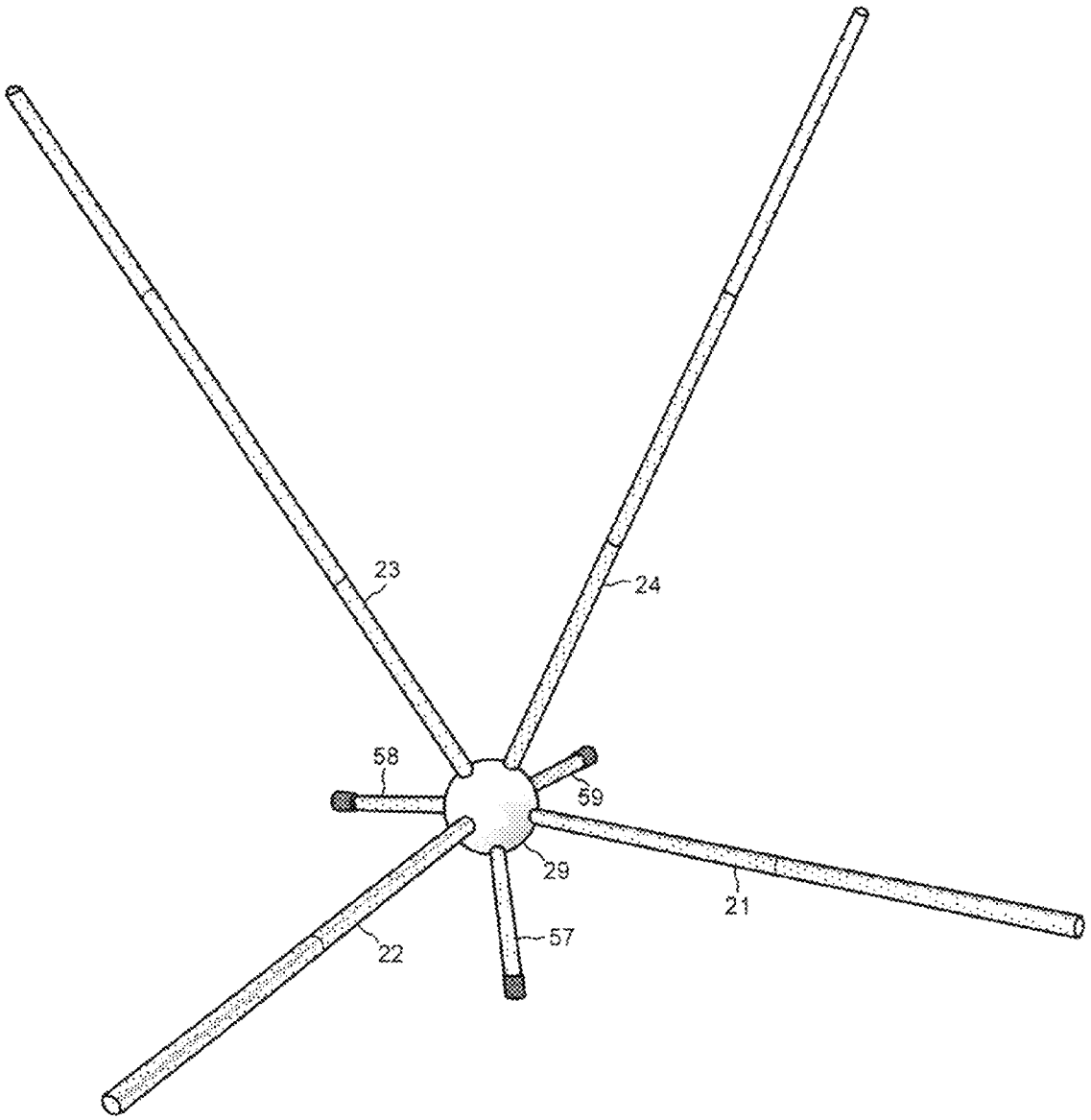
FIG. 14 shows a variation of the embodiment of FIG. 12 in which the central tube connector is a sphere with a larger diameter.

FIG. 14 shows a variation of the embodiment of FIG. 12 in which central tube connector 29 is a sphere with a larger diameter. In the embodiment of FIG. 5, only about the lower inch of the lower sections of upper tubes 21-24 fit into the holes in central tube connector 29. Because the sphere 29 of the embodiment of FIG. 14 has a large diameter, about two inches of the lower sections of upper tubes 21-24 can fit into the holes of sphere 29. About two inches of leg tubes 57-59 also fit into holes of sphere 29. The additional support of the upper tubes 21-24 and leg tubes 57-59 provided by the longer insertion length into central tube connector 29 provides additional stability to the collapsible chair 20 of FIG. 14.

Figure 15:
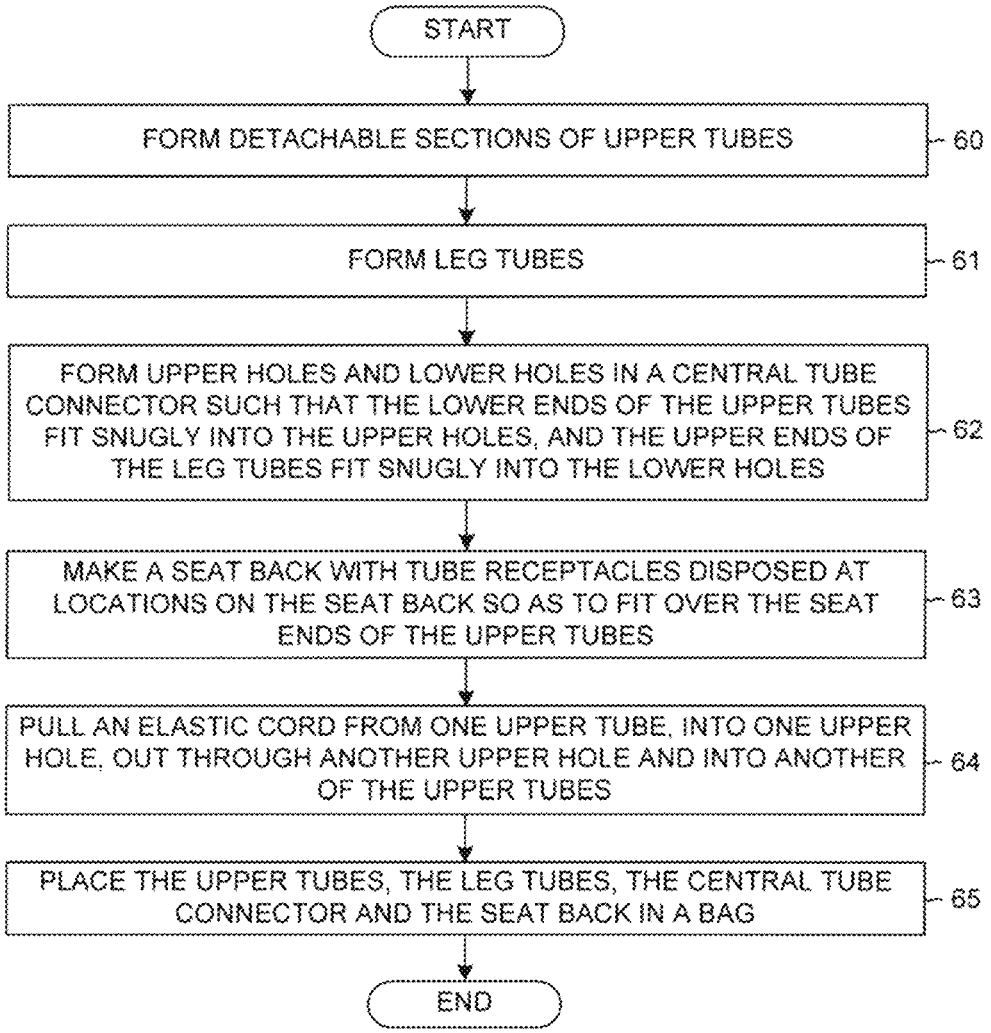
FIG. 15 is a flowchart of steps of a method of manufacturing the collapsible chair of FIG. 3.

FIG. 15 is a flowchart illustrating steps 60-65 of a method of manufacturing collapsible chair 20. In a first step 60, the detachable sections of upper tubes 21-24 are formed from hollow aluminum tubes. Each of the sections has a lower portion with a smaller outer diameter. The lower portions of the upper sections of tubes 23-24 are dimensioned to fit snugly into the tops of the middle sections of tubes 23-24. Similarly, the lower portions of the middle sections of tubes 23-24 are dimensioned to fit snugly into the tops of the lower sections of tubes 23-24. The lower portions of the upper sections of tubes 21-22 are dimensioned to fit snugly into the tops of the lower sections of tubes 21-22. Upper tubes 23-24 are formed when the upper sections are detachably connected to the middle sections, and the middle sections are detachably connected to the lower sections. Upper tubes 21-22 are formed when the upper sections are detachably connected to the lower sections. Tubes 21-24 have lower ends opposite upper seat ends.

In step 61, the leg tubes 25-28 are also formed from hollow aluminum tubes. Each leg tube has only a single section. The leg tubes 25-28 have upper ends and lower ground ends. At the upper ends of leg tubes 25-28 there is an upper portion that has a smaller outer diameter than the rest of the leg tubes.

In step 62, upper holes and lower holes are formed in central tube connector 29. The upper holes are angled upwards, and the lower holes are angled downwards. The lower ends of upper tubes 21-24 are dimensioned to fit snugly into the upper holes, and the upper ends of the leg tubes 25-28 are dimensioned to fit snugly into the lower holes. In one embodiment, central tube connector 29 has upper portion 31 that swivels over lower portion 32, and the upper holes are disposed in upper portion 31, and the lower holes are disposed in lower portion 32.

In step 63, seat back 30 is made with four tube receptacles disposed at the corners of the approximately rectangular seat back so as to fit over the seat ends of upper tubes 21-24. Seat back 30 is made by stitching together various pieces of fabric and plastic and then gluing or stitching the tube receptacles to the fabric or plastic.

In step 64, an elastic cord is pulled through one tube, into a hole, out another hole, and into another tube. For example, an elastic cord that attaches to an end plug of upper tube 23 is pulled through the sections of tube 23, into hole 46, out another hole, through the sections of upper tube 24 and attached to an end plug of tube 24. Similarly, another elastic cord that attaches to ground plug 40 of leg tube 25 is pulled tube 25, into one hole in lower portion 32, out another hole, through leg tube 26 and attached to ground plug 41 of tube 26.

In step 65, all of the tube sections are detached from one another and the tubes are detached from central tube connector 29, as shown in FIG. 5. The tubes are then oriented relatively parallel to one another, and the upper tubes 21-24, the leg tubes 25-28, central tube connector 29 and seat back 30 are placed in a bag. Seat back 30 can be folded and rolled up before being placed in the bag. Because all of the tube sections and leg tubes are less than twelve inches long, the components of collapsible chair 20 fit in a bag that is less than a foot long, which is ideal for camping and hiking. The bag is only about six inches in diameter.

Figure 16A:
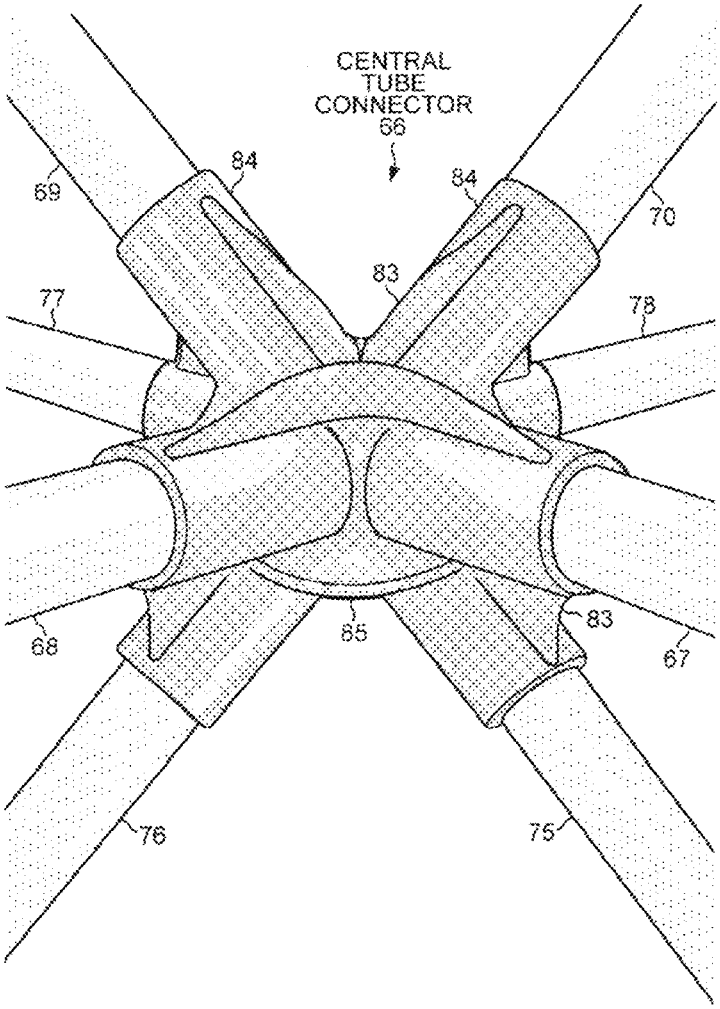
FIG. 16A is a perspective view of a unitary molded central tube connector with the upper and lower tubes attached.
Figure 16B:
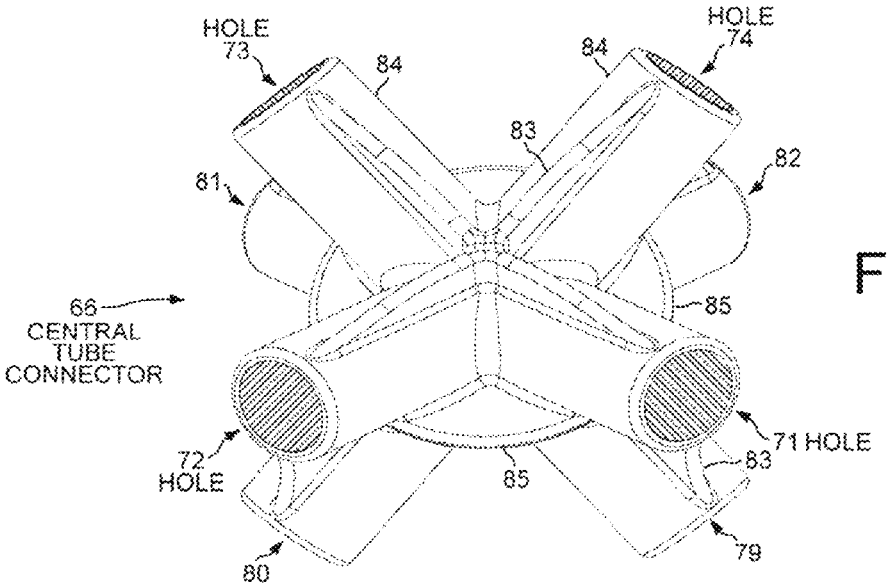
FIG. 16B is a perspective view of the molded tube connector of FIG. 16A without the tubes attached.

FIGS. 16A-B are perspective views of another embodiment of collapsible chair 20 in which a central tube connector 66 is a single unit and does not swivel. FIG. 16A shows tube connector 66 with the upper tubes and leg tubes attached, whereas FIG. 16B shows tube connector 66 alone. Unlike the embodiment of FIG. 11, however, the upper and lower holes are not drilled into a single piece of metal. Instead, unitary central tube connector 66 is molded as a single piece of metal or plastic. When manufacturing collapsible chair 20 with the unitary central tube connector 66 using the method of FIG. 15, the upper and lower holes are formed in step 62 by molding.

In one aspect, central tube connector 66 is die-cast metal, such as aluminum or a zinc alloy that is almost 100% zinc. Zinc is stronger than aluminum, but also heavier and more expensive. By casting the metal, the loss of metal raw materials is eliminated that resulted from turning or lathing the tube connector 55 of FIG. 11 and then drilling holes into the connector. Central tube connector 66 has a plurality of upper holes 71-74 into which the lower ends of upper tubes 67-70 are detachably connected by being inserted into the upper holes in the same manner as the tubes are inserted into central tube connector 55 of FIG. 11. Each of the upper holes 71-74 has a circular circumference, and each of the lower ends of the upper tubes 67-70 has a circular cross section such that there is no space between the lower ends of the upper tubes 67-70 and the circumference of the upper holes 71-74 when the lower ends of the upper tubes are inserted into the upper holes. Similarly, the upper ends of the leg tubes 75-78 are detachably connected to the central tube connector 66 by being inserted into lower holes 79-82. FIGS. 16A-B show reinforcing ribs 83 that run between the cylindrical portions 84 of the connector 66 and hold the cylindrical portions in place. The upper and lower holes are formed in the cylindrical portions 84. Central tube connector 66 also has a central reinforcing disk 85.

In another aspect, central tube connector 66 is injection-molded and made of reinforced plastic. The reinforced plastic is embedded with fibrous matter, such as carbon fiber or fiber glass (FG), in order to confer additional strength to the plastic. The injection-molded plastic is polyethylene (PE) or polyamide (PA) plastic. For example, the polyethylene plastic includes 60% high-density polyethylene (HDPE), 20% low-density polyethylene (LDPE) and 20% linear low-density polyethylene (LLDPE). For polyamide injection molding, the polyamide includes an even mixture of nylon-6 polycaprolactam (PA6) and nylon 6,6 (PA66). A polyamide (nylon) tube connector is generally stronger than a high-density polyethylene (HDPE) tube connector. Polyethylene is more resistant, however, to natural ultraviolet radiation and maintains its strength longer with outdoor use, which is the primary use of collapsible chair 20. For both aspects of the injection molding, pellets of polyethylene or polyamide are melted and then injected as a liquid into the mold. The liquid plastic then sets up in the mold as the plastic cools. The mold used to make the unitary central tube connector 66 has thirteen functional parts.

Figure 17A:
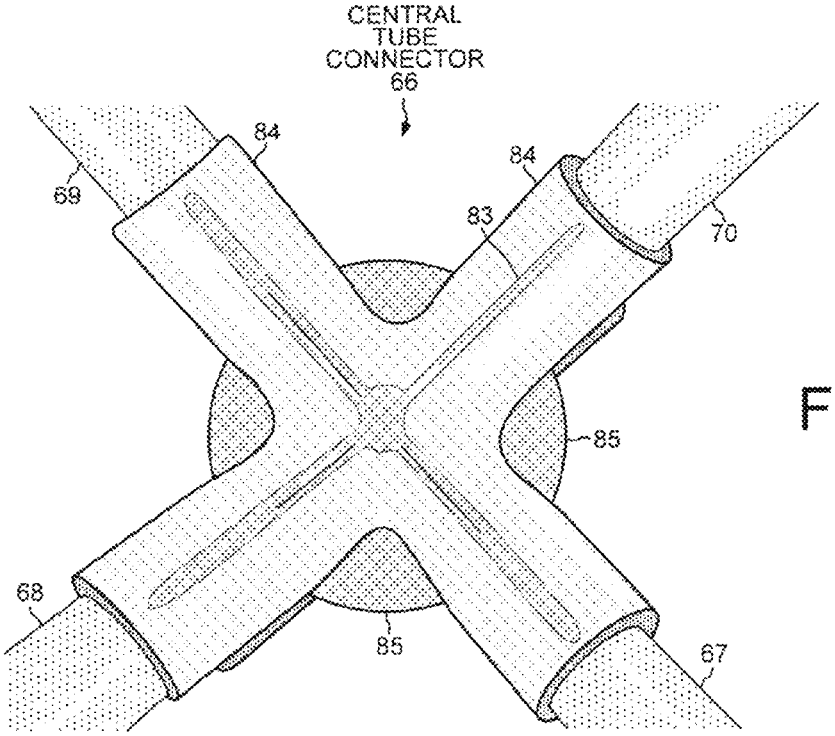
FIG. 17A is a top view of the molded tube connector of FIG. 16A showing the upper tubes attached.
Figure 17B:
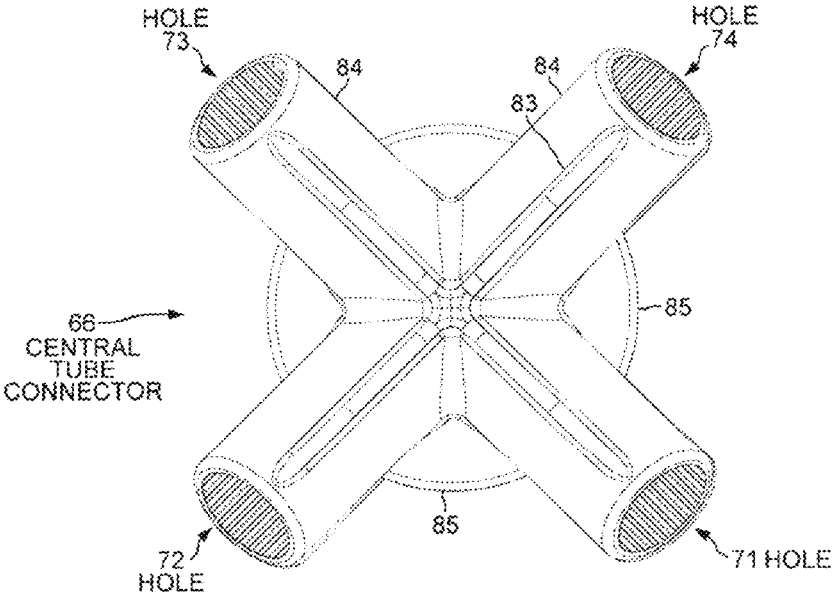
FIG. 17B is a top view of the molded tube connector of FIG. 16A without the tubes attached.

FIGS. 17A-B are top views of central tube connector 66. FIG. 17A shows tube connector 66 with the upper tubes 67-70 attached, and FIG. 17B shows tube connector 66 without any tubes attached. From the top perspective, each of the upper tubes 67-70 exits connector 66 at right angles from the two adjacent upper tubes. Thus, the upper holes 71-74 are oriented at 0, 90, 180 and 270 degrees around the central vertical axis of tube connector 66. The central vertical axis is orthogonal to the central reinforcing disk 85.

Figure 18:
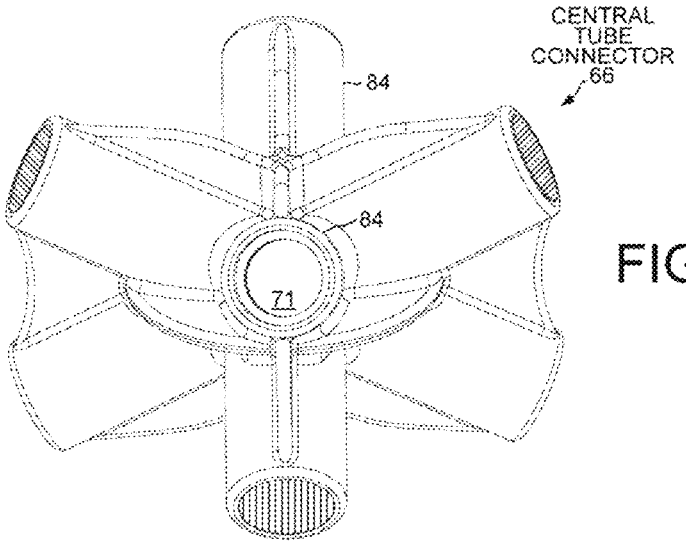
FIG. 18 shows the molded tube connector of FIG. 16B from an axis that passes through the center of an upper hole.
Figure 19:
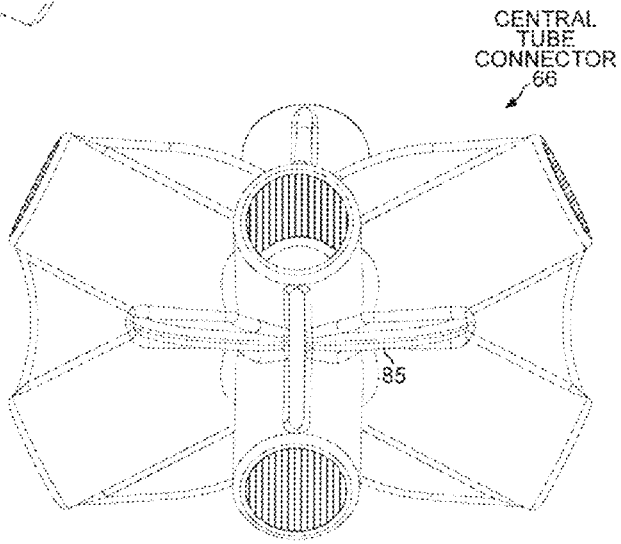
FIG. 19 shows the molded tube connector of FIG. 16B from an angle nearly parallel with a central reinforcing disk.
Figure 20:
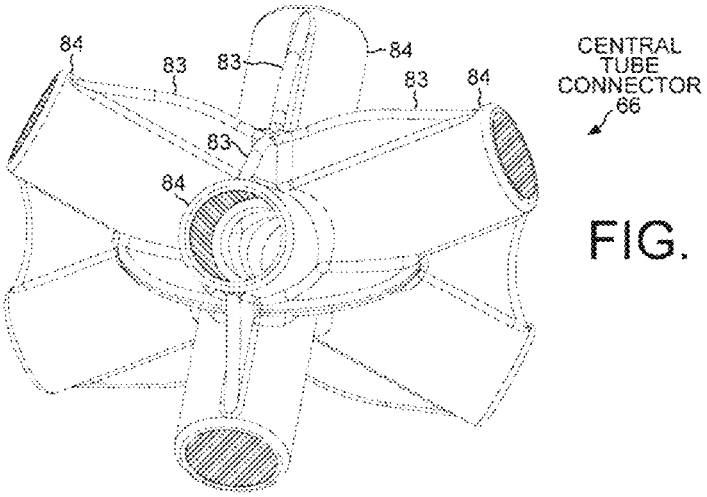
FIG. 20 shows the reinforcing ribs in more detail that run between the upper cylindrical portions of the molded tube connector of FIG. 16B.

FIGS. 18-20 are perspective views from various angles of unitary central tube connector 66. FIG. 18 shows connector 66 from the axis that passes through the center of an upper hole 71 and through the center of one of the cylindrical portions 84. The same axis passes through the center of a lower hole 81 and the corresponding lower cylindrical portion 84. Thus, in the area around tube connector 66, upper tube 67 and leg tube 77 are collinear. FIG. 19 shows central tube connector 66 from an angle nearly parallel with the central reinforcing disk 85. FIG. 20 shows the reinforcing ribs 83 in more detail that run between the upper cylindrical portions 84.

Figure 21:
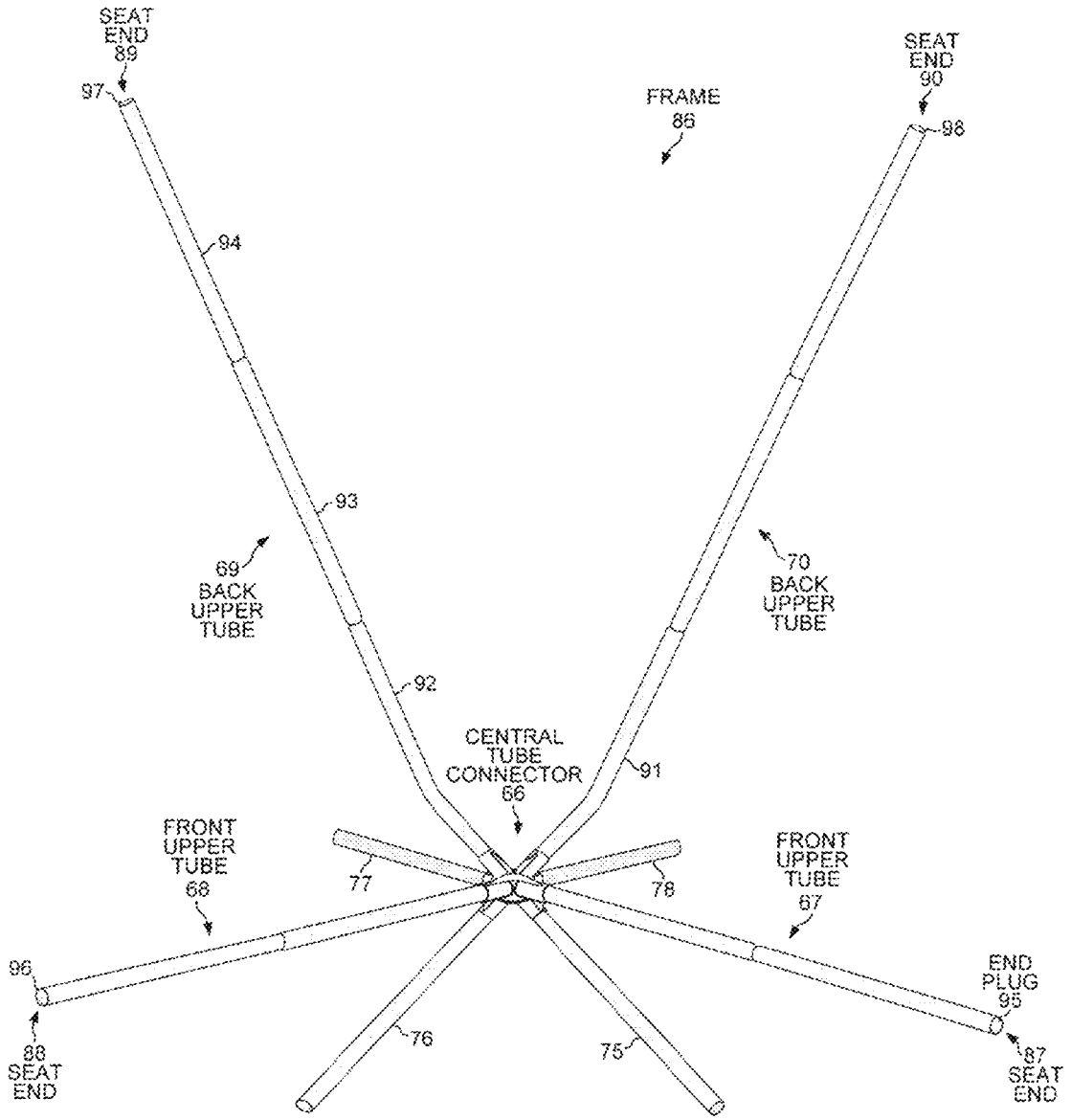
FIG. 21 is a perspective view of the frame of a collapsible chair in which the upper tubes and leg tubes have been attached to the molded central tube connector of FIG. 16A.

FIG. 21 is a perspective view of a frame 86 of a collapsible chair in the assembled state before the tube receptacles at the corners of the seat back 30 have been slipped over the seat ends 87-90 of upper tubes 67-70. Frame 86 is made up of metal tubes and unitary central tube connector 66.

FIG. 21 shows that the back upper tubes 69-70 with three sections have a first length that is longer than the second length of the front upper tubes 67-68, which have only two sections. The longer back upper tubes 69-70 support the back of seat back 30, whereas the shorter front upper tubes 67-68 support the seat of seat back 30 upon which the user's legs rest. The lower sections 91 and 92 of each of the back upper tubes 70 and 69 are curved, whereas the middle and upper sections of the back upper tubes 69-70 are straight. For example, the middle section 93 and the upper section 94 of back upper tube 69 are straight. By curving the back upper tubes 69, 70 upwards at the lower sections 92, 91, the seat ends 89, 90 of the back upper tubes are moved forward closer to the central tube connector 66, and the center of gravity of the occupant of the collapsible chair is moved in front of the central tube connector 66. Thus, bending the lower sections 91-92 allows the center of gravity to be in front of the central tube connector 66 even through the back upper tubes 89-90 that support the back of the seat are significantly longer than the front upper tubes 67-68. The occupant of the collapsible chair is less likely to fall backwards than if the chair had entirely straight back upper tubes. In addition, bending the lower sections 92, 91 moves the back upper tubes 69, 70 away from the bottom of the seat back 30, which is pressed down by the occupant. It would be uncomfortable for the occupant to feel the back support tubes when sinking low into the chair if the back support tubes were entirely straight.

Elastic cords pass through the upper tubes, the central tube connector 66, and then through the leg tubes. The ends of the elastic cords are attached to the inside of plugs that fit into the seat ends of the upper tubes 67-70 or into the bottom ends of the leg tubes 75-78. One elastic cord passes from an end plug 95 at the seat end of front upper tube 67, through tube connector 66 and through back leg tube 77 to a ground plug at the bottom end of back leg tube 77. A second elastic cord passes from an end plug 96 at the seat end of front upper tube 68, through tube connector 66 and through back leg tube 78 to a ground plug at the bottom end of tube 78. A third elastic cord passes from an end plug 97 at the seat end of back upper tube 69, through tube connector 66 and through front leg tube 75 to a ground plug at the bottom end of tube 75. Finally, a fourth elastic cord passes from an end plug 98 at the seat end of back upper tube 70, through tube connector 66 and through front leg tube 76 to a ground plug at the bottom end of tube 76. Thus, there are four elastic cords that each pass through the means 66 for forming the upper and lower holes. For example, a portion of an elastic cord 99 can be seen in FIG. 11 coming out of an upper hole in the central tube connector 55 and passing into an upper tube.

Although certain specific exemplary embodiments are described above in order to illustrate the invention, the invention is not limited to the specific embodiments. Accordingly, various modifications, adaptations, and combinations of various features of the described embodiments can be practiced without departing from the scope of the invention as set forth in the claims.

What is claimed is:

1. A collapsible chair comprising:

a plurality of upper tubes with lower ends and seat ends;

a plurality of leg tubes with upper ends;

a seat back with a plurality of tube receptacles; and a molded central tube connector made of reinforced plastic with a plurality of upper holes and a plurality of lower holes, wherein all of the upper holes are disposed in a unitary upper portion of the molded central tube connector, wherein each of the upper holes has a circular circumference, wherein each of the lower ends of the upper tubes has a circular cross section, wherein the lower ends of the upper tubes are detachably connected to the central tube connector by being inserted into the upper holes, wherein there is no space between the lower ends of the upper tubes and the circumferences of the upper holes when the lower ends of the upper tubes are inserted into the upper holes, wherein the upper ends of the leg tubes are detachably connected to the central tube connector by being inserted into the lower holes, and wherein the seat ends of the upper tubes are detachably connected to the tube receptacles.

2. The collapsible chair of claim 1, wherein the central tube connector is made of polyethylene plastic reinforced with fiber glass.

3. The collapsible chair of claim 1, wherein the central tube connector is made of polyamide plastic.

4. The collapsible chair of claim 1, wherein each of the lower ends is dimensioned to fit snugly into a corresponding upper hole of the central tube connector such that the lower end does not move with respect to the upper hole when the lower end is inserted into the upper hole.

5. The collapsible chair of claim 1, wherein each of the lower ends of the upper tubes is a hollow cylinder.

6. The collapsible chair of claim 1, wherein each of the upper tubes is comprised of detachable sections.

7. The collapsible chair of claim 1, wherein the upper tubes consist of two tubes of a first length and two tubes of a second length, and wherein the first length is longer than the second length.

8. The collapsible chair of claim 7, wherein each of the two tubes of the first length is bent, and wherein neither of the two tubes of the second length is bent.

9. The collapsible chair of claim 7, wherein each of the upper tubes of the first length has a lower section, a middle section and an upper section, wherein the lower end of each upper tube of the first length is disposed on the lower section of the upper tube, wherein each lower section is curved, and wherein each middle section and each upper section is straight.

10. A collapsible chair comprising:

a seat back with tube receptacles;

upper tubes with lower ends and seat ends, wherein the lower ends have circular cross sections;

leg tubes with upper ends; and means for detachably connecting the lower ends of the upper tubes and the upper ends of the leg tubes to a molded material, wherein a unitary portion of the means has upper holes with circular circumferences into which the lower ends of all of the upper tubes are inserted when the lower ends are connected to the means, wherein the means has lower holes into which the upper ends of legs tubes are inserted when the upper ends are connected to the means, and wherein the seat ends of the upper tubes are detachably connected to the tube receptacles.

11. The collapsible chair of claim 10, wherein the means is molded from polyethylene plastic reinforced with fiber glass.

12. The collapsible chair of claim 11, wherein the means includes no metal.

13. The collapsible chair of claim 10, wherein the molded material is taken from the group consisting of: aluminum, zinc, polyethylene plastic and polyamide plastic.

14. The collapsible chair of claim 10, wherein each of the lower ends is dimensioned to fit snugly into a corresponding upper hole in the means such that the lower end does not move with respect to the upper hole when the lower end is inserted into the upper hole.

15. The collapsible chair of claim 10, wherein each of the upper tubes is comprised of detachable sections, and wherein each of the detachable sections is less than one foot long.

16. The collapsible chair of claim 10, wherein the upper tubes consist of two tubes of a first length and two tubes of a second length, wherein the first length is longer than the second length, wherein each of the two tubes of the first length is bent, and wherein neither of the two tubes of the second length is bent.

17. The collapsible chair of claim 10, further comprising:

an elastic cord that passes through one of the upper tubes and into the means.

18. A method comprising:

forming upper tubes with lower ends and seat ends, wherein the upper tubes are formed in sections, and wherein the lower ends have circular cross sections;

forming leg tubes with upper ends;

molding a central tube connector with upper holes and lower holes, wherein the upper holes have circular circumferences and are disposed at ends of cylindrical portions of the central tube connector, wherein the circular cross sections of the lower ends are dimensioned to fit snugly into the circular circumferences of the upper holes, wherein all of the upper holes are disposed in a unitary upper portion of the central tube connector, and wherein the upper ends of the leg tubes are dimensioned to fit snugly into the lower holes; and making a seat back with tube receptacles disposed at locations on the seat back so as to fit over the seat ends of the upper tubes when the upper tubes are inserted into the upper holes.

19. The method of claim 18, wherein the central tube connector is molded from a material taken from the group consisting of: aluminum, zinc, polyethylene plastic and polyamide plastic.

20. The method of claim 18, further comprising:

placing the upper tubes, the leg tubes, the central tube connector and the seat back in a bag that is less than one foot long.

* * * * *